US011131526B2

(12) United States Patent
Shawley et al.

(10) Patent No.: US 11,131,526 B2
(45) Date of Patent: Sep. 28, 2021

(54) HANDGUN SLIDE WITH EMBEDDED SIGHT ASSEMBLY

(71) Applicant: Sig Sauer, Inc., Newington, NH (US)

(72) Inventors: Jacob Thomas Shawley, Somersworth, NH (US); Phillip H. Strader, Jr., Stratham, NH (US); Trevor Eaton, South Hampton, NH (US); Jesse Cole, Newmarket, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/899,066

(22) Filed: Jun. 11, 2020

(65) Prior Publication Data

US 2021/0033369 A1 Feb. 4, 2021

Related U.S. Application Data

(60) Provisional application No. 62/860,482, filed on Jun. 12, 2019.

(51) Int. Cl.

| | |
|---|---|
| ***F41G 1/06*** | (2006.01) |
| ***F41G 1/32*** | (2006.01) |
| ***F41G 1/10*** | (2006.01) |
| ***F41G 1/34*** | (2006.01) |
| ***F41A 3/66*** | (2006.01) |

(52) U.S. Cl.

CPC ..... *F41G 1/10* (2013.01); *F41A 3/66* (2013.01); *F41G 1/06* (2013.01); *F41G 1/32* (2013.01); *F41G 1/345* (2013.01)

(58) Field of Classification Search

CPC ..... F41G 1/06; F41G 1/10; F41G 1/32; F41G 1/345

See application file for complete search history.

(56) References Cited

U.S. PATENT DOCUMENTS

| | | | | | |
|---|---|---|---|---|---|
| 1,363,553 | A * | 12/1920 | Barringer | F41G 1/12 | 42/145 |
| 2,546,777 | A * | 3/1951 | Pierce | F41G 1/06 | 42/136 |
| 3,190,002 | A * | 6/1965 | Bliss | F41G 1/42 | 33/228 |
| 3,192,632 | A * | 7/1965 | Von Stavenhagen | F41G 1/02 | 42/144 |
| 4,628,611 | A * | 12/1986 | Ruffino | F41G 1/16 | 42/137 |
| 4,918,823 | A * | 4/1990 | Santiago | F41G 1/32 | 42/132 |

(Continued)

OTHER PUBLICATIONS

Personal Defense World, "8 Reflex-Ready Handguns Right Out of the Box" available at https://www.personaldefenseworld.com/2014/12/8-reflex-ready-handguns-right-out-of-the-box/. (Retrieved Dec. 8, 2014). 5 pages.

*Primary Examiner* — Derrick R Morgan

(74) *Attorney, Agent, or Firm* — Finch & Maloney PLLC

(57) ABSTRACT

A handgun slide has a slide body extending longitudinally and includes sides extending down from a top surface. A proximal end portion of the slide body defines a recess configured to receive a sight assembly. A sight assembly can be installed in the recess of the slide by placing the sight assembly in the recess, followed by securing the assembly to the slide. In its installed configuration, at least part of the sight assembly's point-of-aim indicator is recessed below the top surface of the slide.

6 Claims, 6 Drawing Sheets

(56) References Cited

U.S. PATENT DOCUMENTS 5,878,521 A * 3/1999 Warnock ..... F41G 1/345 42/145
6,035,539 A * 3/2000 Hollenbach ..... F41G 1/32 42/132
6,068,483 A * 5/2000 Minor ..... F41G 3/30 42/111
6,122,833 A * 9/2000 Lorocco ..... F41G 1/32 42/132
6,367,189 B1 * 4/2002 Clay ..... F41G 1/01 42/111
D611,113 S * 3/2010 Kay ..... D22/109
8,997,393 B2 * 4/2015 Bar Yona ..... F41G 1/027 42/132
9,285,186 B1 * 3/2016 Di Veroli ..... F41G 1/32
9,453,706 B1 * 9/2016 Crispin ..... F41G 1/26
9,658,030 B1 * 5/2017 Heacock ..... F41G 1/345
9,823,044 B1 * 11/2017 Cabrera ..... F41G 1/17
9,869,526 B1 * 1/2018 Cheng ..... F41G 1/17
10,024,628 B2 * 7/2018 Toner ..... F41G 1/16
10,088,275 B1 * 10/2018 Warren ..... F41G 1/345
10,180,306 B2 1/2019 Ben Zion et al.
10,563,955 B2 * 2/2020 Pniel ..... F41G 1/16
10,830,560 B2 * 11/2020 Barnett ..... F41G 1/01
10,871,350 B1 * 12/2020 Thomas ..... F41G 1/16
10,969,195 B1 * 4/2021 Clark ..... F41G 1/02
2004/0010956 A1 * 1/2004 Bubits ..... F41G 1/345 42/144
2006/0207157 A1 * 9/2006 Keng ..... F41G 1/32 42/132
2007/0266573 A1 * 11/2007 Wilson ..... F41G 1/32 33/265
2008/0092423 A1 * 4/2008 Keng ..... F41G 11/003 42/111
2008/0092424 A1 * 4/2008 Keng ..... F41G 1/18 42/137
2008/0092425 A1 * 4/2008 Keng ..... F41G 1/26 42/145
2011/0197491 A1 * 8/2011 McCann ..... F41G 11/003 42/132
2011/0314721 A1 * 12/2011 Lamb ..... F41G 1/345 42/145
2012/0311912 A1 * 12/2012 Howe ..... F41G 1/18 42/111
2013/0111799 A1 * 5/2013 Lee ..... F41C 27/00 42/106
2013/0219767 A1 * 8/2013 Peterson ..... F41G 1/10 42/113
2014/0096430 A1 * 4/2014 Kruse ..... F41G 1/345 42/132
2014/0223797 A1 * 8/2014 Bar Yona ..... F41G 1/027 42/111
2014/0250758 A1 * 9/2014 Orlob ..... F41G 1/01 42/132
2015/0241175 A1 * 8/2015 Wolf ..... F41G 11/005 42/124
2016/0102942 A1 * 4/2016 Abo ..... F41G 1/345 42/132
2017/0184375 A1 * 6/2017 Huff ..... F41G 11/001
2017/0219313 A1 * 8/2017 Howe ..... F41G 1/12
2018/0087871 A1 * 3/2018 Toner ..... F41G 1/16
2018/0195835 A1 * 7/2018 Crispin ..... F41G 1/30
2019/0257620 A1 * 8/2019 Zimmer ..... F41G 11/001
2019/0331461 A1 * 10/2019 Zimmer ..... F41G 1/17
2020/0025520 A1 * 1/2020 Niswander ..... F41G 11/003
2020/0103201 A1 * 4/2020 Cabrera ..... F41G 1/02
2020/0232601 A1 * 7/2020 Chavez ..... F16M 11/041
2020/0271419 A1 * 8/2020 Grace ..... F41G 1/545
2020/0278166 A1 * 9/2020 Adika ..... F41G 1/16
2020/0333108 A1 * 10/2020 Berean ..... F41G 1/01

* cited by examiner

HANDGUN SLIDE WITH EMBEDDED SIGHT ASSEMBLY

RELATED APPLICATIONS

This application claims the benefit under 35 U.S.C. § 119(e) of U.S. Provisional Patent Application No. 62/860,482, titled HANDGUN SLIDE WITH EMBEDDED SIGHT ASSEMBLY, and filed on Jun. 12, 2019, the contents of which are incorporated by reference herein in its entirety.

FIELD OF THIS DISCLOSURE

This disclosure relates to sighting systems for firearms and more specifically to a sight assembly and to a handgun slide with the sight assembly recessed into its top surface.

BACKGROUND

Firearms operators have traditionally used some type of sights to assist in making a shot impact a target at the desired location. For example, rifles and pistols often include a front sight and a rear sight mounted over the top of the barrel, where the operator aligns the front sight (e.g., a post) with the rear sight (e.g., a notch or V) to establish a sight picture that includes the intended target. Such sights may be referred to as "iron sights" since they traditionally have been made of metal. More recently, iron sights have been modified to include an optical fiber to enhance visibility in daylight conditions, or to include a radioactive material (e.g., tritium vial) that illuminates part of the sight for shooting in low light conditions. Other sights are configured as optical or telescopic sights. Such sights generally include a reticle, such as cross hairs, for the operator to superimpose on the target when looking through the sight. In yet another example, a reflex sight (or "red dot" sight) is configured for the operator to look through a non-magnifying or low-magnification glass onto which the operator can see a reflection of an illuminated aiming point superimposed over the field of view.

Figure 1:
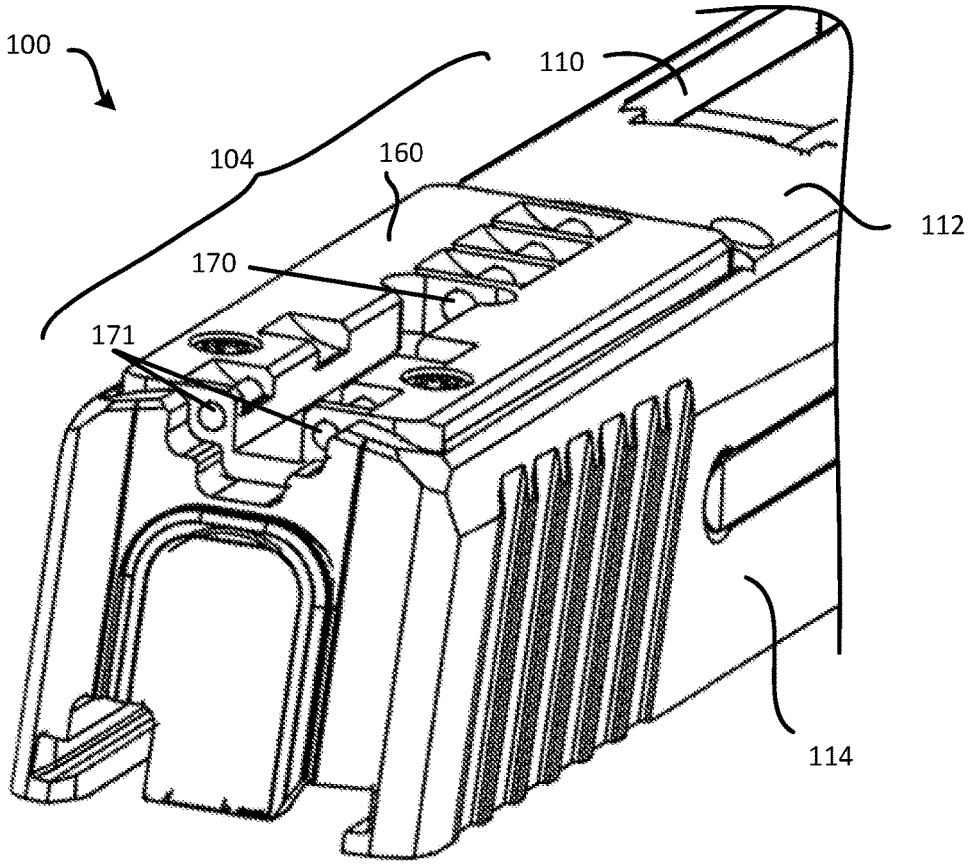
FIG. 1 illustrates a rear perspective view showing a proximal end portion of a handgun slide that includes a sight assembly received in a recess in the top of the slide, in accordance with one embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed herein is a sight assembly, a handgun slide with the sight assembly recessed into a top of the slide, and a handgun including the slide and sight assembly. A handgun slide is configured for reciprocating movement along the top of a handgun frame and includes a slide body with sides extending down from a top portion. The slide includes a proximal end portion located proximally of an ejection port. The top of the proximal end portion defines a recess constructed to receive a sight assembly. For example, the recess has a rectangular shape and is bound on at least three sides by adjacent portions of the slide, such as a front wall and opposed side walls. When the sight assembly is installed in the recess, all or a majority of the sight assembly is recessed below the top surface of the slide and the point-of-aim indicator is visible from the rear end of the handgun. In some embodiments, the top surface of the sight assembly, or a top of the point-of-aim indicator, is flush with the top surface of the slide. In some embodiments, a rear wall extends along the rear end of the sight and defines an opening so that the point-of-aim indicator is visible through the opening.

In one embodiment, the sight assembly includes optical fibers that collect ambient light. When viewed from the rear end of the handgun, the sight assembly has an illuminated center dot between left and right alignment dots. The user can aim the handgun using a sight picture in which the center dot is evenly spaced between the left and right dots and the three dots are aligned along a horizontal line. In one such embodiment, the center optical fiber is axially spaced forward of the right and left alignment dots so that the sight assembly has a sight radius of two to three centimeters, or about 2.5 cm, suitable for close quarters combat and shooting distances typical of self-defense encounters. The sight radius can be increased or decreased by adjusting the axial spacing of the center and side optical fibers as permitted by the geometry of the slide.

A method of installing a sight assembly is also disclosed. In one example, a sight assembly can be installed in the recess defined in the top of a handgun slide by placing the sight assembly in the recess, followed by securing the assembly to the slide with fasteners. In its installed configuration, at least part of the sight assembly's point-of-aim indicator is recessed below the top surface of the slide. In some embodiments, the sight assembly is flush with the top surface of the slide when it is installed in the recess.

General Overview

Firearms design and use involves many non-trivial issues. For instance, constructing a handgun for concealed carry may include changes to the design to reduce its overall size.

To reduce the propensity of the handgun to snag on clothing, a handgun can be "dehorned" to soften corners and edges on the slide and frame, for example. One such feature that tends to snag clothing is the front and rear sights that protrude from the top of the slide. To facilitate faster sight acquisition, some sights have a rectangular shape with distinct corners to help the user visually align the sights. Such features tend to catch on clothing during holstering and drawing the handgun, even despite attempts to round the outside portions of these features. In some cases, the sights are installed in a dovetail slot that extends laterally across the top of the slide. For similar reasons, the edges of the dovetail slot are also prone to snag on clothing.

In one approach, a fiber optic sight assembly can be mounted to the top surface of the slide using the dovetail slot, thus eliminating the front and rear posts of traditional sights. Such sight assemblies have been made wider than a traditional rear sight and occupy most of the width of the slide's top surface. By increasing the width of the assembly, exposed ends of the dovetail slot can be covered to reduce the ability of the dovetail slot to catch on clothing. However, since the sight assembly protrudes above the top of the slide, it is still prone to snagging on clothing. Additionally, the sight effectively increases the height of the slide and the width of the sight assembly also reduces the user's ability to see around the sight.

In another approach, a fiber optic sight can be attached to the top of the handgun slide. The sight includes a center dot surrounded by an outer ring, each of which is illuminated using optical fibers. The user aims by centering the center dot within the outer circle. A limitation of such sights is that it is more difficult for the user to perceive small misalignment of concentric circles than in traditional iron sights. Accordingly, it can more difficult for the shooter to hit the intended target.

In light of the shortcomings and challenges of existing sights, a need exists for a handgun sight that is effective for target acquisition while also reducing the likelihood of snagging clothing. The present disclosure addresses these needs and others.

In accordance with one embodiment, a sight assembly is recessed into the top of a handgun slide so that one or more point-of-aim indicators are visible to the user at the rear end of the handgun. For example, the sight assembly is secured into a recess defined in the top of the slide such that at least a portion of the point-of-aim indicator is below the top surface of the slide. In some such embodiments, the slide lacks a front sight and the recessed sight assembly is below, is flush with, or minimally protrudes from the top surface of the slide. As a result, the slide's sight system advantageously has a reduced propensity to snag on clothing while drawing or holstering the handgun. Also, when the sight assembly is recessed into the top of the slide, the point-of-aim indicator(s) are closer to the bore axis of the handgun. Further, the top surface of the slide can be used for aiming as an alternate to or in conjunction with the sight's point-of-aim indicator(s), in accordance with some embodiments.

In accordance with some embodiments of the present disclosure, a handgun slide with recessed sight assembly can be used with a wide variety of host firearms, including, but not limited to semiautomatic handguns configured for duty use, concealed carry, competitive shooting, and recreation. In particular, semiautomatic handguns configured for concealed carry can benefit from a slide and sight as variously described in the present disclosure. In some examples, the disclosed slide is configured to be utilized with a semiautomatic handgun chambered for any suitable pistol cartridge. Examples of some host firearms include the P365, P226, P320, and P938 handguns manufactured by Sig Sauer, Inc. Other suitable host firearms will be apparent in light of this disclosure. As will be further appreciated, the particular configuration (e.g., materials, dimensions, etc.) of a slide and the sight assembly as described herein may vary, for example, depending on whether the intended use is military, law enforcement, or civilian in nature. Numerous configurations will be apparent in light of this disclosure.

Example Slide Configuration

Figure 2:
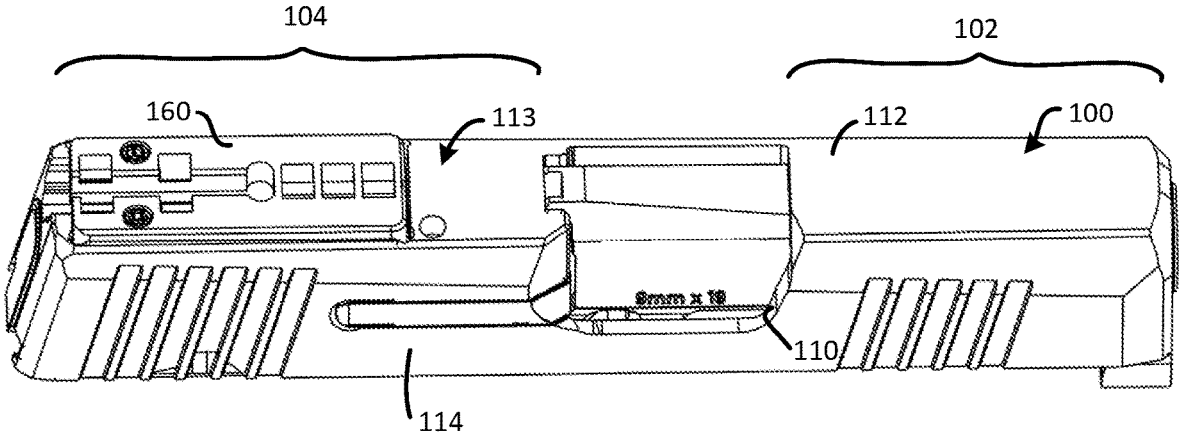
FIG. 2 is a top and side perspective view showing the handgun slide of FIG. 1, in accordance with one embodiment of the present disclosure.
Figure 3:
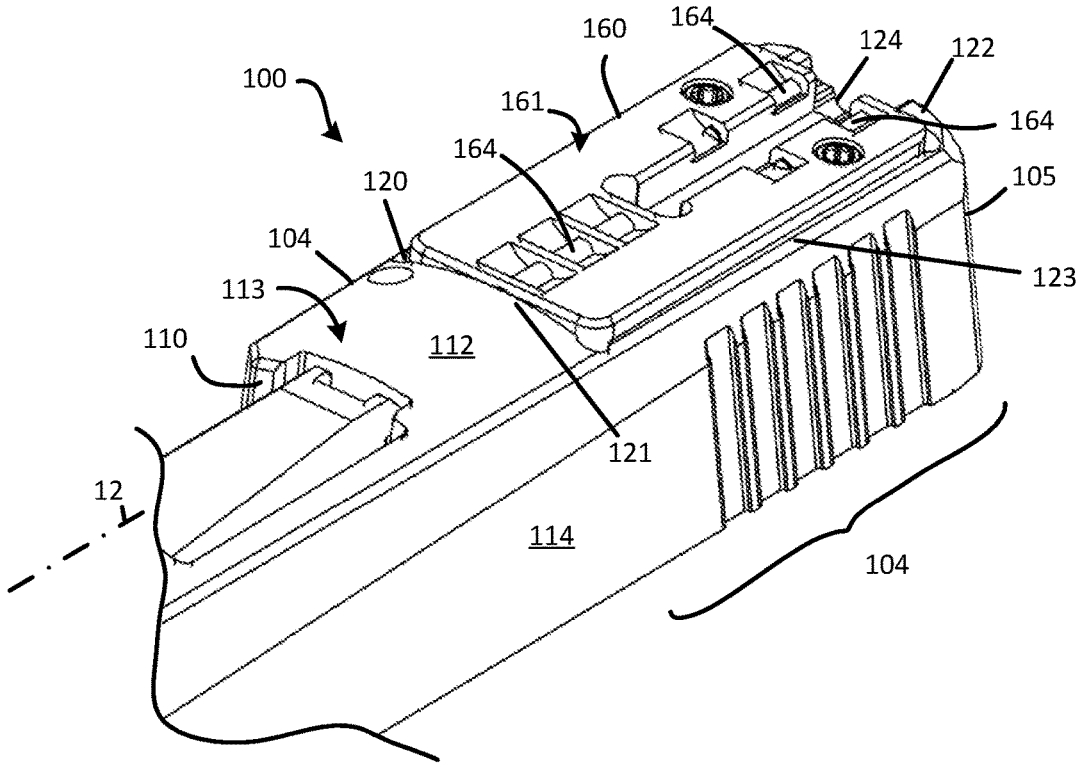
FIG. 3 is a perspective view showing the top and left sides of a proximal end portion of the handgun slide of FIG. 1, in accordance with one embodiment of the present disclosure.
Figure 4:
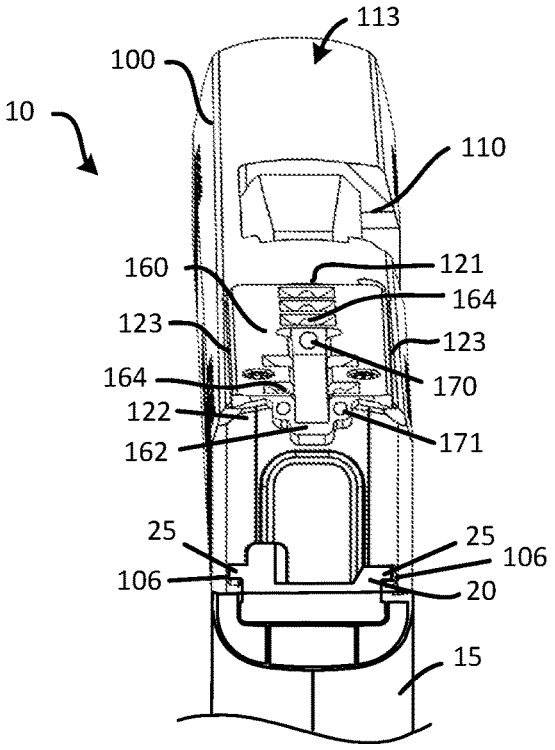
FIG. 4 illustrates the top and rear sides of the slide and portion of a handgun, in accordance with one embodiment of the present disclosure.
Figure 5:
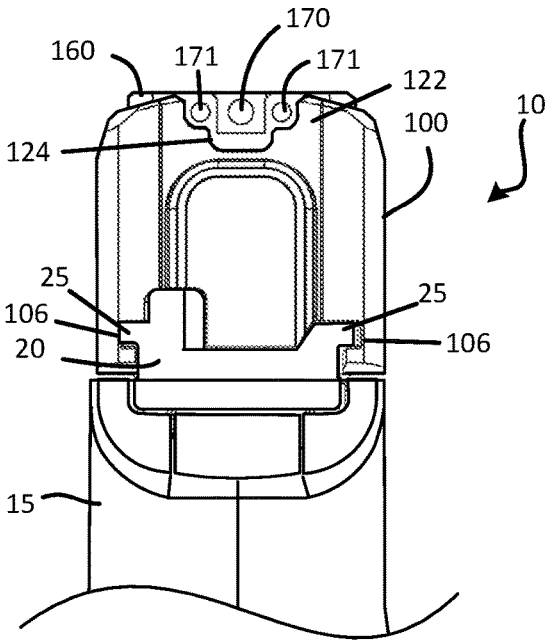
FIG. 5 is a rear view of part of a handgun and shows the sight assembly and point-of-aim indicator recessed into the top of the handgun slide as may be viewed by the operator, in accordance with one embodiment of the present disclosure.

FIGS. 1-5 illustrate various views of a handgun slide 100 that includes a sight assembly 160 recessed into a top surface 113 of the slide 100, in accordance with an embodiment of the present disclosure. FIG. 1 is a rear perspective view of part of the slide 100 and shows the sight assembly 160 recessed into the proximal end portion 104 of the slide 100; FIG. 2 is a top and side view showing the slide 100 and sight assembly 160; FIG. 3 is a top, front, and side perspective view showing a proximal end portion 104 of the slide 100 with sight assembly 160; FIG. 4 is a top and rear-end view of part of a handgun 10 showing the slide 100 and sight assembly 160; and FIG. 5 is a rear elevational view of part of a handgun 10 and shows the point-of-aim indicator 170 of the sight assembly 160 as may be viewed by a user. Concurrent reference to these figures will facilitate explanation.

In this example embodiment, the slide 100 is constructed to reciprocate axially along the top of a frame or grip module 15 that houses the receiver 20 and components of the fire control group (not visible). The receiver 20 includes a pair of opposed parallel rails 25 that slidingly engage corresponding rail slots 106 extending along the inside of the slide 100. During the firing cycle, the slide 100 reciprocates axially along the receiver 20 between a battery position and a recoil position, as will be appreciated.

The slide 100 extends longitudinally along a central axis 12 and includes a distal end portion 102 and a proximal end portion 104 spaced apart axially by an ejection port 110. The slide 100 generally has a cross-sectional shape of an inverted U as defined by a top portion 112 and opposed side portions 114 that extend down from the top portion 112. In this example embodiment, the top portion 112 and side portions 114 define a generally rectangular profile where the top portion 112 is flat or rounded with a relatively large radius of curvature (e.g., a radius of 15 mm or greater, including about 20 mm, 25 mm, 30 mm, or 35 mm and all ranges between these values). In other embodiments, the top portion 112 can have a smaller radius of curvature, such as defining a semicircular profile (e.g., a radius of ~12 mm). In yet other embodiments, the regions between the top portion 112 and side portions 114 can be rounded, faceted, chamfered, planar, or have some other profile. Numerous variations and embodiments will be apparent in light of the present disclosure.

The proximal end portion 104 of the slide 100 defines a recess 120 in the top surface 113, where the recess 120 is sized and configured to receive a sight assembly 160 of corresponding geometry. For example, the recess 120 has a rectangular shape oriented longitudinally along the slide 100 and has a depth of 2-4 mm. In some embodiments, the recess 120 is defined so that portions of the slide 120 surround the recess 120 on at least three sides, or at least on portions of three sides. For example, the recess 120 has a front wall 121, a rear wall 122, and lateral walls 123. In another embodiment, the recess 120 is configured without a rear wall 122 so that the rear end 162 of the sight assembly 160 is visible at the proximal end 105 of the slide 100. That is, part of the proximal end 105 of the slide is machined or formed so the recess 120 has no rear wall 122 and the rear end 162 of the sight assembly 160 is visible to the operator across with width of the recess 120.

In some embodiments, the sight assembly 160 includes a point-of-aim indicator 170 on the rear end 162 or visible from the rear end 162, such as a bullseye, crosshair, triangle, or other shape. The sight assembly 160 may further include one or more alignment indicators 171. In one example, the sight assembly 160 includes right and left alignment indicators 171 where the point-of-aim indicator 170 is positioned between the alignment indicators 171 as viewed from the rear end of the sight assembly 160. The sight assembly 160 can include an optical fiber 164, a self-luminous gas tube or material (e.g., tritium vial), reflective substance, or a combination of these materials. In one example, the sight assembly 160 includes optical fibers 164 that are illuminated at the end of the fiber by impinging ambient light. For example, a center optical fiber 164 is positioned between left and right optical fibers 164 so that when viewed by a user from the rear end of the slide 100, the center optical fiber 164 is the point-of-aim indicator 170 and the right and left optical fibers 164 are used for sight alignment. In some such embodiments, the rear wall 122 defines an opening 124 positioned to enable the user to see the point-of-aim indicator 170 from the rear end of the slide 100 when the sight assembly 160 is installed in the recess 120. For example, the opening 124 is a through-hole, a notch, or a channel that is centrally located on the rear wall 122 and extends to the recess 120 to make visible the point-of-aim indicator 170 of the sight assembly 160. The opening 124 can have a rounded, rectangular, or other shape.

In some embodiments, such as shown in the rear view of FIG. 5, the recess 120 has a vertical depth so that at least half of the sight assembly 160 is below the top surface 113 of the slide 100. For example, the top of the point-of-aim indicator 170 is flush with the top surface 113 of the slide 100. In other embodiments, the top surface 161 of the sight assembly 160 is flush with or recessed below the top surface 113 of the slide 100. In yet other embodiments, less than 50%, less than 40%, less than 30%, less than 20%, less than 10%, or less than 5% of the sight assembly 160 extends above the top surface 113 of the slide 100.

Although portions of the sight assembly 160 near the right and left portions of the slide 100 are shown in FIG. 5 as protruding slightly above the top surface 113 of the slide 100, it will be appreciated that the sight assembly 160 can be shaped to have a contour matching that of the top surface 113 of the slide 100. For example, the sight assembly 160 has top surface 161 that is domed, faceted, planar, or has some other geometry that corresponds to the top surface 113 of the slide 100 and results in a flush appearance when the sight assembly 160 is installed in the recess 120.

Figure 6:
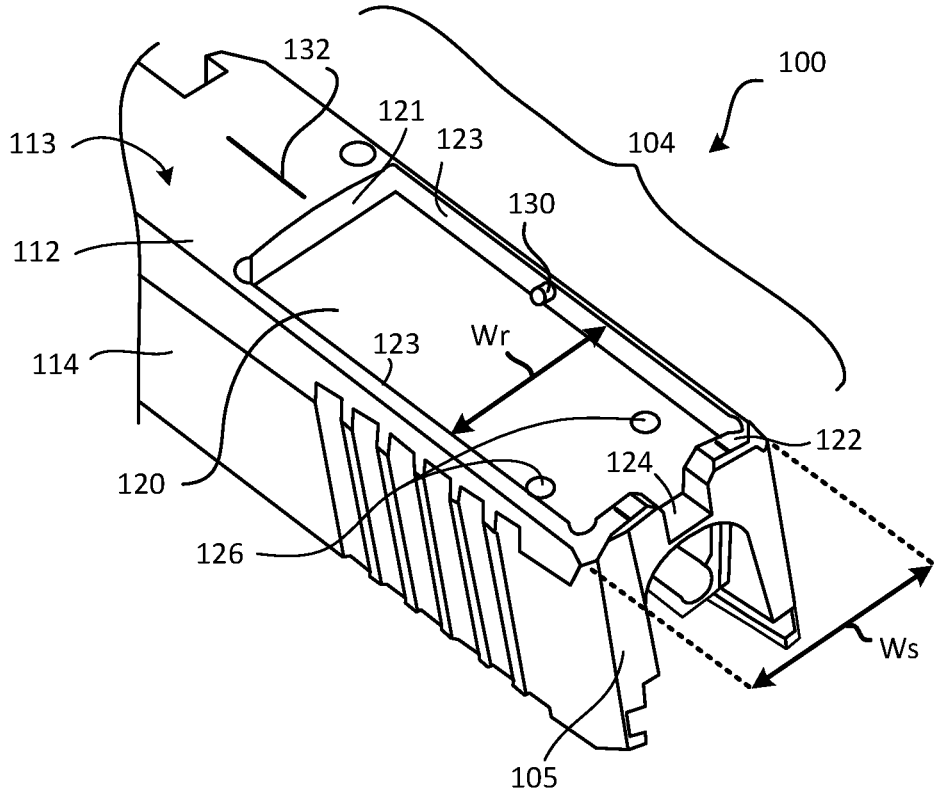
FIG. 6 is a perspective view showing the top, left and rear sides of a proximal end portion of a handgun slide, in accordance with one embodiment of the present disclosure.

FIG. 6 illustrates a perspective view showing the top, rear, and left side of a proximal end portion 104 of a slide 100, in accordance with an embodiment of the present disclosure. A recess 120 is defined in the top portion 112 of the slide 100 adjacent the proximal end 105. In this example, the recess 120 is spaced from the proximal end 105 of the slide 120 so as to define a rear wall 122. The rear wall 122 defines an opening 124 aligned with the center of the slide 100 (e.g., aligned vertically with the bore axis of handgun 10). In this example, the opening 124 is a notch or channel with a rectangular shape. In other embodiments, the opening has a circular shape, a V-shape, a stepped shape, or some other suitable geometry.

The recess 120 has a recess width Wr that can be less than or equal to a slide width Ws of slide 100 as measured at the top portion 112. For example, the recess width Wr is less than the slide width Ws by 2 mm, 3 mm, 4 mm, 5 mm or some other amount. In another example, the recess width Wr is equal to the slide width Ws so that side walls 123 are eliminated. That is, the recess 120 can extend laterally across the full slide width Ws of the slide 100 in some embodiments. The axial length of the recess 120 is generally less than that of the proximal end portion 104 of the slide 100 by at least 4 mm, such as to allow a front wall 121 and a rear wall 122 each having an axial wall thickness of at least 2 mm. In some embodiments, the recess 120 has an axial length of about 35-45 mm, such as about 42 mm, or other length suitable to accommodate the sight assembly 160.

The sight assembly 160 can be secured in the recess 120 using one or more methods, including mechanical fasteners, magnetic fasteners, a press fit, an adhesive, and combinations of these and other methods. In accordance with one embodiment, the top portion 112 of the slide 100 defines at least one fastener opening 126 within the recess 120, such as two, three, four, six, or other number of fastener openings 126. Each fastener opening 126 is positioned to align with a corresponding fastener opening of a sight assembly 160 that may be installed in the recess 120. For example, the fastener openings 126 can be threaded bores configured to receive complimentary fasteners 166 that are arranged at various locations to accommodate the hole pattern of any particular one of several sight assemblies 160. In embodiments where machine screws or other fasteners 166 are used to secure the sight assembly 160, the fasteners can extend vertically through the sight assembly 160 and into the fastener openings 126 in the slide 100. In other embodiments, a fastener 166 can extend laterally through a side wall 123 and/or rear wall 105 of the slide to engage the sight assembly 160 located in the recess 120.

In some embodiments, a recess width Wr of recess 120 is intentionally or incidentally greater in size than a width W of the sight assembly 160 (shown in FIG. 7) so as to allow room for the user to adjust the lateral and/or longitudinal position of the sight assembly 160 in the recess 120. In any event, the slide 100 optionally includes one or more alignment indicia 132, such as one or more dots, lines, or other marking that facilitates alignment of the sight assembly 160 with the bore axis. In some such embodiments, one or more adjustment fasteners 130 extend laterally through the slide 100 (e.g., through side wall 123 and/or rear wall 122) into the recess 120 to contact or engage the sight assembly 160. In some embodiments, the adjustment fastener 130 can be used to laterally position the sight assembly 160 in the recess or to adjust the lateral position of the point-of-aim indicator 170. In other embodiments, adjustment fastener 130 can be used to secure the sight assembly 160 in the recess 120. Numerous variations and embodiments will be apparent in light of the present disclosure.

Figure 7:
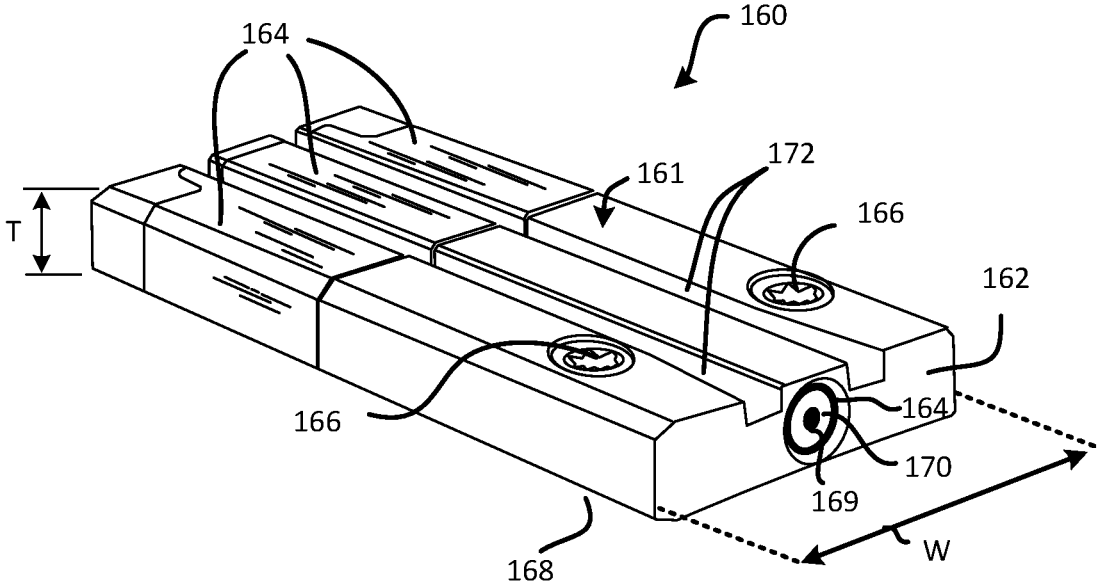
FIG. 7 is a perspective view showing the top, left and rear sides of a sight assembly, in accordance with one embodiment of the present disclosure.

FIG. 7 illustrates a rear perspective view showing an example embodiment of a sight assembly 160 that can be installed in the recess 120 on the slide 100. In this example embodiment, the sight assembly 160 has a relatively flat and rectangular shape with a vertical thickness T commensurate with the depth of the recess 120. In some embodiments, the thickness T is no more than 2 mm, no more than 3 mm, no more than 4 mm, no more than 5 mm, from 1-5 mm, from 2-3 mm, from 2-4 mm, or some other suitable thickness. In this example, the sight assembly 160 has a generally planar and smooth bottom surface 168 (not visible). A point-of-aim indicator 170 is located on a rear end 162 and is configured as a bullseye with a center dot and outer ring. Other point-of-aim indicators 170 are acceptable and include cross hairs, a vertical line, a dot, a triangle, a V, or other suitable configuration. The sight assembly 160 includes an optical fiber 164 that collects ambient light to illuminate the point-of-aim indicator 170. In some embodiments, the sight assembly 160 alternately or additionally includes a luminescent or radioactive material, such as a tritium vial (not visible) or the like, that illuminates all or part of the point-of-aim indicator 170. For example, the self-luminous gas tube 169 is coaxially arranged with the optical fiber 164 such that the optical fiber 164 is around the outside of the tube 169 or vice versa.

Fasteners 166 extend vertically through the sight assembly 160 and are positioned to engage the corresponding fastener openings 126 in the slide 100. In this example embodiment, the sight assembly 160 defines longitudinal slots 172 in its top surface 161. In some such embodiments, the portions of the sight assembly 160 above the slots 172 may extend above the top surface 113 of slide 100. In some embodiments, the top surface 161 of the sight assembly 160 protrudes above the top surface 113 of the slide 100 by no more than 2 mm, for example, no more than 1.5 mm, or no more than 1.0 mm.

Figure 8:
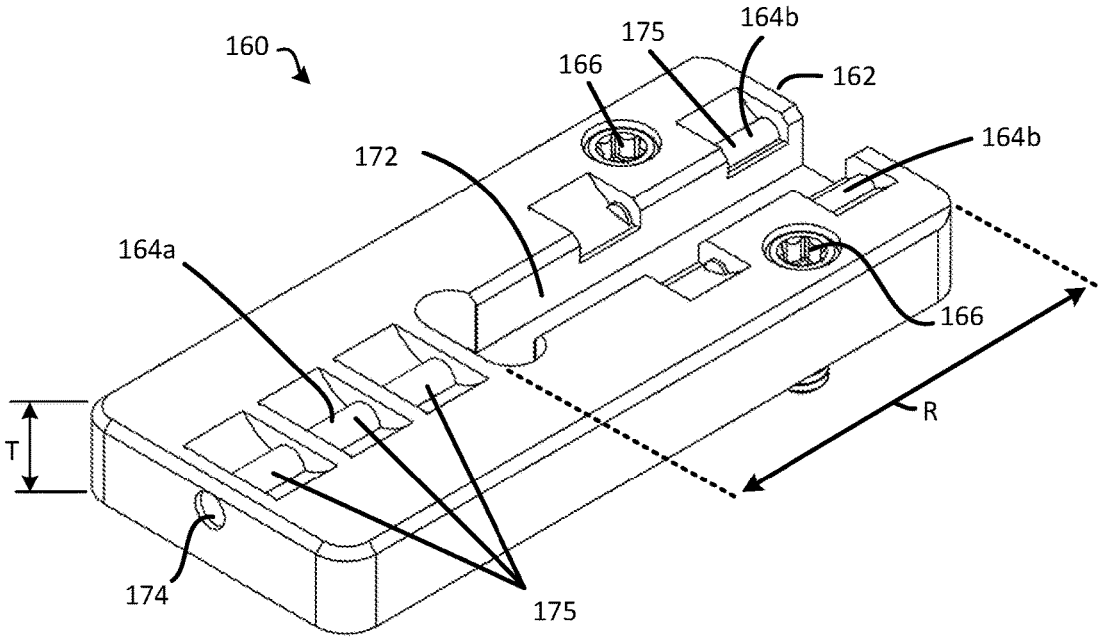
FIG. 8 is a top and front perspective view of a sight assembly, in accordance with another embodiment of the present disclosure.
Figure 9:
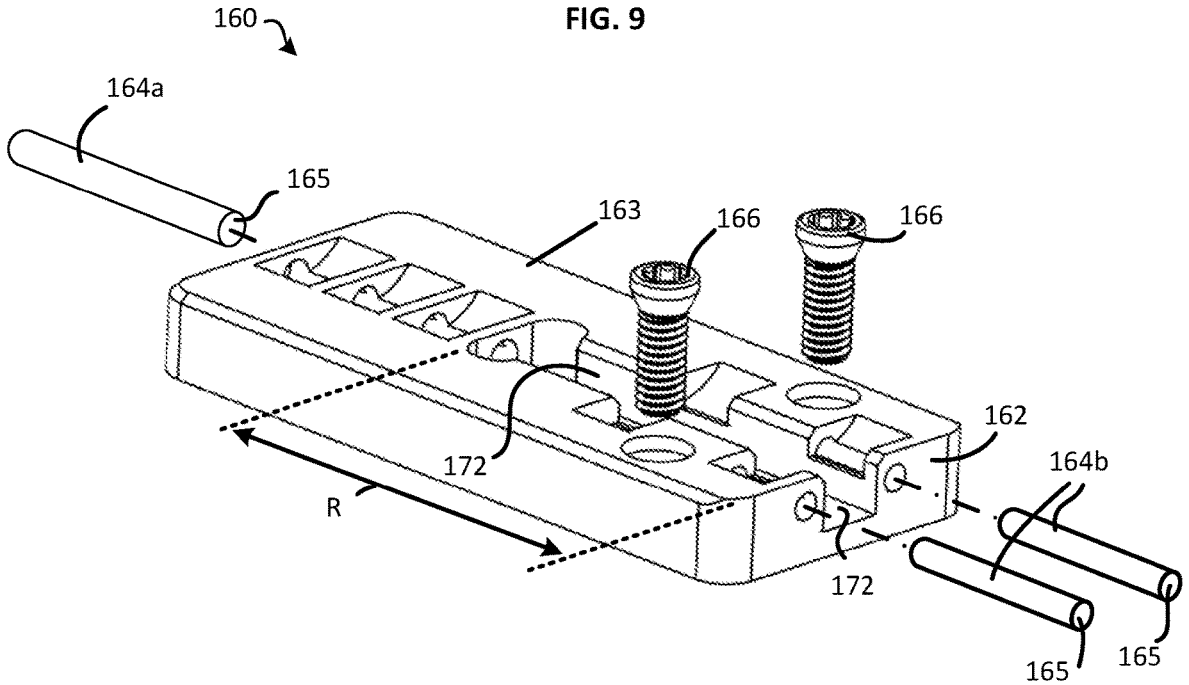
FIG. 9 is an exploded, top, and rear perspective view showing components of the sight assembly of FIG. 8, in accordance with an embodiment of the present disclosure.

Referring now to FIGS. 8 and 9, a sight assembly 160 is shown with optical fibers 164, in accordance with another embodiment of the present disclosure. FIG. 8 illustrates a top and front perspective view of the sight assembly 160 in an assembled form with fasteners 166. FIG. 9 illustrates a rear perspective view showing an exploded view of the sight assembly 160. In this example, the sight assembly 160 includes a sight body 163 that retains one or more optical fibers 164. As shown, for example, the sight assembly 160 includes a center optical fiber 164*a* and two side optical fibers 164*b*. The optical fibers 164 are distributed along an imaginary horizontal line with the center optical fiber 164*a* centered laterally between the side optical fibers 164*b*. The top of each optical fiber 164 is exposed along at least part of its length to receive impinging ambient light. An end 165 of each optical fiber 164 is visible to the user when looking at the rear end 162 of the sight 160. As will be appreciated, the exposed portion of the optical fiber 164 contributes to the apparent brightness at the end 165 of the fiber. The end 165 of the center optical fiber 164*a* is the point-of-aim indicator 170 in this example. In some embodiments, side optical fibers 164*b* and/or the center optical fiber 164*a* can be omitted and replaced with a dot, tritium vial, reflective surface, or other indicator that is visible to the user at least in lighted conditions.

The end 165 of the center optical fiber 164*a* is axially spaced from ends 165 of the side optical fibers 164*b*, which are flush with the rear end 162 of the sight assembly 160. Accordingly, the sight assembly 160 defines a sight radius R as the axial distance between the end 165 of the center optical fiber 164*a* and ends 165 of the side optical fibers 164*b*. The end 165 of the center optical fiber 164*a* is visible through a channel or slot 172 that extends axially along the sight assembly 160. The sight radius R is at least 2 centimeters (cm) in some embodiments, such as 2.5 cm 2-3 cm, or at least 3 cm, for example. In some embodiments, the center optical fiber 164*a* has a greater diameter, greater axial length, or both compared to the side optical fibers 164*b*. The center optical fiber 164*a* can also have an increased exposed axial length and/or increased diameter compared to that of the side optical fibers 164*b* so as to enhance the apparent brightness of the center optical fiber 164*a*. For example, the center optical fiber 164*a* has an exposed length of at least 10 mm, including 10-15 mm, or about 12 mm. The side optical fibers 164*b* can have an exposed axial length of 3-6 mm, including about 4 mm or about 5 mm. Thus, the exposed portion of the center optical fiber 164*a* can be 2×, 2.5×, 3×, 3.5×, or other multiple of the exposed portion of each side optical fiber 164*b*. In some embodiments, the center optical fiber 164*a* has a diameter of 1.5-2.5 mm, such as 2.0 mm, and each side optical fiber 164*b* has a diameter of 1.0 mm-2.0 mm, such as 1.5 mm. Centers of adjacent optical fibers 164 can be spaced laterally from 2-4 mm, such as 3 mm, 3.25 mm, or 3.5 mm. As shown in the example of FIG. 8, the center optical fiber 164*a* has three exposed regions 175 of 4 mm axial length and the side optical fibers 164*b* each have an exposed region 175 of 4 mm axial length. Numerous variations and embodiments will be apparent in light of the present disclosure.

In some embodiments, the center optical fiber 164*a* has a different color than the side optical fibers 164*b*. In some embodiments, the center optical fiber 164*a* is replaceable via an end opening 174 in the sight body 163. When the sight assembly 160 is installed in the slide 100, the end opening 174 is at least partially blocked by the front wall 121. To change the color of the point-of-aim indicator 170, for example, the user can use the end opening 174 to remove and replace the center optical fiber 164*a* with an optical fiber 164 of a different color when the sight assembly 160 is removed from the recess 120 in the slide 100. Numerous variations and embodiments will be apparent in light of the present disclosure.

Figure 10:
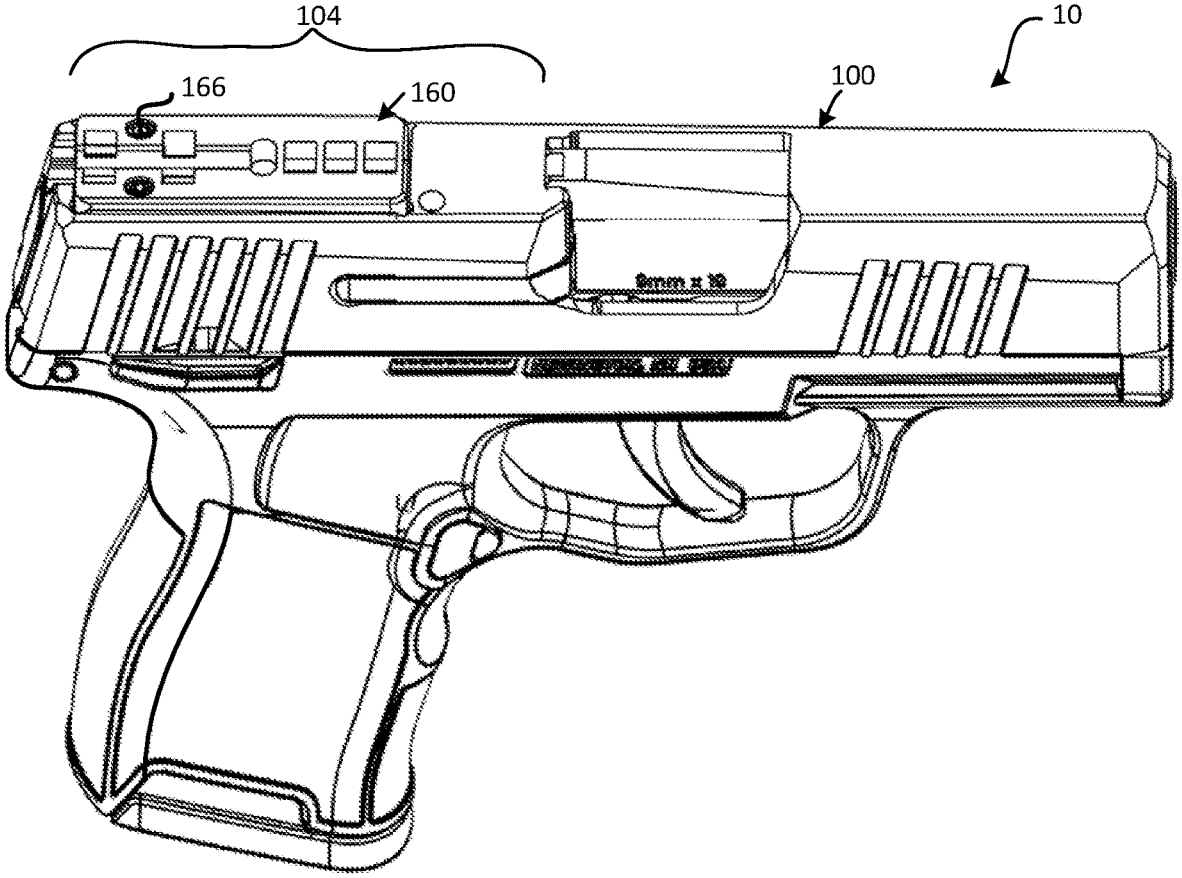
FIG. 10 illustrates a top and side view of a handgun with a sight assembly recessed into the top of the slide, in accordance with an embodiment of the present disclosure.

FIG. 10 illustrates a side perspective view of a semiautomatic handgun 10 that includes a slide 100 equipped with the sight assembly 160 as shown in FIGS. 8-9, in accordance with an embodiment of the present disclosure. As discussed above, the sight assembly 160 is recessed or embedded into the top of the proximal end portion 104 of the slide 100 and secured to the slide 100 using fasteners 166. In this example, the sight assembly 160 is nearly flush with the top surface 113 of the slide 100.

Method of Installation

Figure 11:
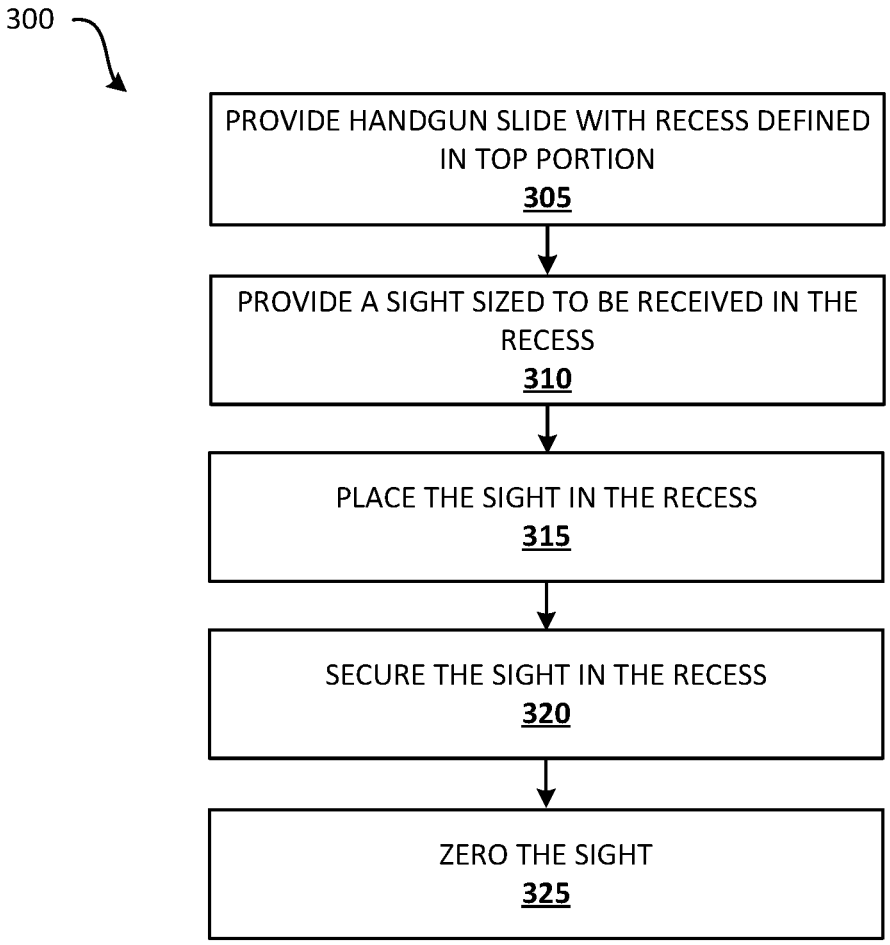
FIG. 11 is a flow diagram showing steps in a method of installing a sight assembly on a handgun slide, in accordance with some embodiments of the present disclosure.

FIG. 11 illustrates a flow diagram with steps in a method 300 of installing a sight assembly on a handgun slide, in accordance with some embodiments. Method 300 begins with providing 305 a handgun slide that defines a recess in a top portion of the slide, and providing 310 a sight assembly sized to be received in the recess. Examples of a slide 100 and sight assembly 160 are discussed above. In one embodiment, providing 305 the slide includes selecting the slide to include a notch defined in a rear end of the slide to expose the point-of-aim indicator when the sight assembly is installed. In some embodiments, providing 305 the handgun slide includes machining the recess in the slide. For example, a completed slide (as manufactured for sale) is later machined to define the recess in the top portion of the slide adjacent the rear end, where the recess has a vertical depth and dimensions corresponding to those of the sight assembly.

Method 300 continues with placing 315 the sight assembly in the recess. Placing 315 the sight assembly includes positioning the point-of-aim indicator along the rear of the slide so that the point-of-aim indicator is at least partially recessed below the top surface of the slide. Fastener openings in the sight assembly are aligned with appropriate fastener openings in the slide located within the recess. As part of placing 315 the sight assembly in the recess, some or all of the sight assembly is recessed below a top surface of the slide. Placing 315 the sight assembly may further include aligning the point-of-aim indicator with an opening in a rear wall, and/or with a center indicator on the slide.

Method 300 continues with securing 320 the sight assembly to the slide. In one embodiment, fasteners are installed vertically through the sight assembly's fastener openings and into corresponding fastener openings within the recess. In other embodiments, fasteners are installed horizontally through the slide and into the sight assembly. In yet other embodiments, securing 320 the sight assembly includes applying an adhesive between the sight assembly and the recess.

Method 300 optionally continues with zeroing 325 the sight assembly. For example, the sight assembly can be visually aligned with a zero indicator on the slide, such as alignment indicia. In another example, the lateral position of the sight assembly or point-of-aim indicator can be adjusted within the recess using an adjustment fastener that moves the sight assembly (or part thereof) laterally within the recess by advancing or retracting the fastener. In yet other embodiments, zeroing 325 the sight assembly includes adjusting the vertical position of the point-of-aim indicator with respect to the notch in the slide. Additional vertical adjustment may include changing the angle of the sight assembly 160 in relation to slide recess 120 so that point-of-aim indicator 170 is angled either upward or downward in relation to the plane of slide recess 120. This can be achieved my raising or lowering one end of the sight assembly 160 while retaining the opposing end in position. Zeroing 325 the sight assembly may further include adjusting the position of the point-of-aim indicator based on shooting results, as will be appreciated.

Note that steps in method 300 are shown in a particular order for ease of description. However, one or more of the steps may be performed in a different order or may not be performed at all (and thus be optional), in accordance with some embodiments. Numerous variations on method 300 and the techniques described herein will be apparent in light of this disclosure.

FURTHER EXAMPLE EMBODIMENTS

The following examples pertain to further embodiments, from which numerous permutations and configurations will be apparent.

Example 1 is a handgun slide comprising a slide body extending longitudinally along a central axis between a distal end and a proximal end, the body having sides extending down from a top surface, wherein a proximal end portion of the body defines a recess in the top surface, the recess adjacent the proximal end, configured to receive a sight assembly therein, and generally having a rectangular shape bounded by a front wall and opposed side walls.

Example 2 includes the subject matter of Example 1, wherein the recess is further bounded by a rear wall at the proximal end of the slide body, the rear wall defining a central opening.

Example 3 includes the subject matter of Examples 1 or 2, wherein the recess has a depth of at least 2 mm.

Example 4 includes the subject matter of any of Examples 1-3 and further comprises a sight assembly secured in the recess, the sight assembly including a point-of-aim indicator and alignment indicators that are visible from a rear end of the handgun slide.

Example 5 includes the subject matter of Example 4, wherein the point-of-aim indicator is below the top surface of the slide.

Example 6 includes the subject matter of any of Examples 4-5, wherein a top surface of the sight assembly is flush with the top surface of the slide.

Example 7 includes the subject matter of any of Examples 4-5, wherein a top surface of the sight assembly protrudes above the top surface of the slide body by no more than 2 mm.

Example 8 includes the subject matter of Example 7, wherein a top surface of the sight assembly protrudes above the top surface by no more than 1 mm.

Example 9 includes the subject matter of any of Examples 4-8, wherein the sight assembly comprises a sight body extending along the central axis between a front end and a rear end, the sight body having a vertical thickness of less than 5 mm; and at least one optical fiber retained by the sight body and oriented along the central axis, wherein a portion of the at least one optical fiber is exposed to ambient light and has an end face oriented transversely to the central axis, and wherein a top surface of the sight assembly protrudes above the top surface of the slide body by no more than 2 mm.

Example 10 includes the subject matter of Example 9, wherein the at least one optical fiber includes a central optical fiber, a left optical fiber, and a right optical fiber, wherein the central optical fiber is centered laterally between the left optical fiber and the right optical fiber, and wherein the point-of-aim indicator includes an end face of the central optical fiber.

Example 11 includes the subject matter of Example 10, wherein the end face of the central optical fiber is axially spaced by at least 2 cm from an end face of the left optical fiber and an end face of the right optical fiber.

Example 12 includes the subject matter of Examples 10 or 11, wherein the slide body defines a channel oriented along the central axis, the end face of the central optical fiber visible in the channel from the rear end of the handgun slide.

Example 13 is a handgun slide comprising a slide body extending longitudinally along a central axis from a proximal end to a distal end and including a proximal end portion, the body having sides extending down from a top portion with a top surface, wherein the proximal end portion of the body defines a recess in the top portion; and a sight assembly secured in the recess, the sight assembly including (i) a sight body extending along the central axis between a front end and a rear end, and (ii) a point-of-aim indicator visible to a user looking at the rear end of the sight body, wherein the sight assembly extends above the top surface of the slide body by no more than 2 mm.

Example 14 includes the subject matter of Example 13 and further comprises left and right alignment indicators visible on the rear end of the sight body, wherein the point-of-aim indicator is positioned laterally between the left and right alignment indicators as viewed from the rear end, and wherein the point-of-aim indicator is spaced distally of the left and right alignment indicators Example 15 includes the subject matter of Examples 14, wherein the point-of-aim indicator is spaced distally of the left and right alignment indicators by at least 2 cm.

Example 16 includes the subject matter of any of Examples 14-15, wherein the left and right alignment indicators each comprise at least one of an optical fiber and a self-illuminating tube.

Example 17 includes the subject matter of any of Examples 13-16, wherein the point-of-aim indicator comprises at least one of an optical fiber and a self-illuminating tube.

Example 18 includes the subject matter of Examples 16 or 17, wherein the self-illuminating tube comprises tritium.

Example 19 includes the subject matter of any of Examples 13-18, wherein a sight body has a vertical thickness of not more than 5 mm.

Example 20 includes the subject matter of Example 13 and further comprises at least one optical fiber retained by and oriented along the central axis of the sight body, wherein a portion of the at least one optical fiber is exposed to ambient light and has an end face generally perpendicular to the central axis.

Example 21 includes the subject matter of Example 20, wherein the at least one optical fiber includes a central optical fiber, a left optical fiber, and a right optical fiber, the central optical fiber centered laterally between the left optical fiber and the right optical fiber; wherein the point-of-aim indicator comprises an end face of the central optical fiber, and wherein the end face of the central optical fiber is axially spaced by a sight radius from an end face of the left optical fiber and from an end face of the right optical fiber.

Example 22 includes the subject matter of Example 21, wherein the sight radius is at least 2 cm.

Example 23 is a sight assembly for a handgun having a slide, the sight assembly comprising a sight body extending along a central axis between a front end and a rear end and having a vertical thickness of not more than 5 mm; a point-of-aim indicator visible to a user looking at the rear end of the sight body; and left and right alignment indicators visible on the rear end of the sight body, wherein the point-of-aim indicator is positioned laterally between the left and right alignment indicators as viewed from the rear end, and wherein the point-of-aim indicator is spaced distally of the left and right alignment indicators.

Example 24 includes the subject matter of Example 23, wherein the point-of-aim indicator comprises at least one of an optical fiber and a self-illuminating tube.

Example 25 includes the subject matter of Examples 23 or 24, wherein the left and right alignment indicators each comprise at least one of an optical fiber and a self-illuminating tube.

Example 26 includes the subject matter of Examples 24 or 25, wherein the self-illuminating tube comprises tritium.

Example 27 includes the subject matter of any of Examples 23-26, wherein the point-of-aim indicator is spaced distally of the left and right alignment indicators by at least 2 cm.

Example 28 is a sight assembly for a handgun having a slide, the sight assembly comprising a sight body extending along a central axis between a front end and a rear end and having a vertical thickness of not more than 5 mm; at least one optical fiber retained by the sight body and oriented along the central axis of the sight body, wherein a portion of the at least one optical fiber is exposed to ambient light and has an end face generally perpendicular to the central axis; and a point-of-aim indicator visible to a user looking at the rear end of the sight body; wherein the sight assembly is sized and configured to be secured in a recess defined in a top of a handgun slide.

Example 29 includes the subject matter of Example 28, wherein the at least one optical fiber includes a central optical fiber, a left optical fiber, and a right optical fiber, the central optical fiber centered laterally between the left optical fiber and the right optical fiber, wherein the point-of-aim indicator comprises an end face of the central optical fiber.

Example 30 includes the subject matter of Example 29, wherein the end face of the central optical fiber is axially spaced by a sight radius from an end face of the left optical fiber and from an end face of the right optical fiber.

Example 31 includes the subject matter of Example 30, wherein the sight radius is at least 2 cm.

Example 32 is a method of installing a sight on a handgun slide, the method comprising providing a handgun slide defining a recess in the top surface adjacent a proximal end of the slide; placing a sight assembly in the recess such that the sight assembly extends above the top surface of the handgun slide by no more than 2 mm, the sight assembly including a point-of-aim indicator on a rear end; and securing the sight assembly in the recess with the point-of-aim indicator positioned at or below the top surface of the slide.

Example 33 includes the subject matter of Example 32, wherein securing the sight assembly includes installing fasteners vertically through the sight assembly and into the slide.

Example 34 includes the subject matter of Examples 33 or 34, wherein providing the handgun slide includes selecting the slide having the recess bounded by a front wall, opposed side walls, and a rear wall that defines a central opening, the point-of-aim indicator aligned with and visible through the central opening.

Example 35 includes the subject matter of any of Examples 32-34, wherein securing the sight assembly includes installing fasteners through a wall bounding the recess and into the sight assembly.

Example 36 includes the subject matter of any of Examples 32-35 and further comprises aligning a position of the point-of-aim indicator.

Example 37 is a handgun comprising the handgun slide of any of Examples 1-22.

Example 38 includes the subject matter of Example 37, wherein the handgun slide lacks a front sight.

Example 39 is a handgun comprising the sight assembly of any of Examples 23-31.

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the invention, which is set forth in the following claims.

What is claimed is:

1. A handgun slide comprising:

a slide body extending longitudinally along a central axis from a proximal end to a distal end and including a proximal end portion, the body having sides extending down from a top portion with a top surface and a rear wall at the proximal end, wherein the proximal end portion of the body defines a recess in the top portion and an upper portion of the rear wall defines an opening to the recess; and a sight assembly secured in the recess, the sight assembly comprising a sight body extending along the central axis between a front end and a rear end, the sight body housing at least one of an optical fiber or a self-luminous tube; and a point-of-aim indicator on the at least one optical fiber or self-luminous tube, the point-of-aim indicator visible through the opening to a user looking at the rear end of the sight body, wherein at least a majority portion of the point-of-aim indicator is below the top surface of the slide body.

2. The handgun slide of claim 1 further comprising:

left and right alignment indicators visible on the rear end of the sight body and visible through the opening in the rear wall of the slide body, wherein the point-of-aim indicator is positioned laterally between the left and right alignment indicators as viewed from the rear end, and wherein the point-of-aim indicator is spaced distally of the left and right alignment indicators.

3. The sight assembly of claim 2, wherein the point-of-aim indicator is spaced distally of the left and right alignment indicators by at least 2 cm.

4. The sight assembly of claim 2, wherein the left and right alignment indicators each comprises at least one of an optical fiber and a self-illuminating tube.

5. The handgun slide of claim 2, wherein the sight assembly houses at least one optical fiber including a first optical fiber with the point-of-aim indicator on an end face of the first optical fiber, the first optical fiber oriented along the central axis of the sight body, wherein a portion of first optical fiber is exposed to ambient light and the end face has an orientation that is generally perpendicular to the central axis.

6. The handgun slide of claim 2, wherein the at least one optical fiber or self-luminous tube includes a central optical fiber, a left optical fiber, and a right optical fiber, the central optical fiber positioned laterally between the left optical fiber and the right optical fiber;

wherein the point-of-aim indicator comprises an end face of the central optical fiber, and wherein the end face of the central optical fiber is axially spaced at least 2 cm from an end face of the left optical fiber and from an end face of the right optical fiber.

* * * * *